United States Patent [19]

Owens

[11] 4,085,998

[45] Apr. 25, 1978

[54] DUAL CLIP CONNECTOR

[75] Inventor: James L. Owens, Clemmons, N.C.

[73] Assignee: Western Electric Company, Inc., New York, N.Y.

[21] Appl. No.: 755,399

[22] Filed: Dec. 29, 1976

[51] Int. Cl.[2] ..... H01R 13/12

[52] U.S. Cl. ..... 339/258 P; 339/275 B

[58] Field of Search ..... 339/17 LC, 17 LM, 17 M, 339/176 MF, 176 MP, 258, 275

[56] References Cited

U.S. PATENT DOCUMENTS

| | | | |
|---|---|---|---|
| 2,291,674 | 8/1942 | Alden | 339/207 |
| 2,701,346 | 2/1955 | Powell | 339/176 MP |
| 2,832,942 | 4/1958 | French | 339/176 MP |
| 2,947,964 | 8/1960 | Johanson et al. | 339/17 LM |
| 2,953,766 | 9/1960 | Clewes | 339/17 LM |
| 3,270,311 | 8/1966 | Deer et al. | 339/17 |
| 3,479,634 | 11/1969 | Pritulsky | 339/17 |
| 3,555,493 | 1/1971 | Baumanis | 339/176 MP |
| 3,611,275 | 10/1971 | Teddy | 339/258 P |
| 3,689,684 | 9/1972 | Cox, Jr. et al. | 339/17 R |
| 3,701,071 | 10/1972 | Landman | 339/17 M |
| 3,750,252 | 8/1973 | Landman | 29/191.6 |
| 3,790,916 | 2/1974 | Keitel | 339/95 R |
| 3,805,117 | 4/1974 | Hausman | 317/101 CP |

*Primary Examiner*—Joseph H. McGlynn
*Attorney, Agent, or Firm*—J. B. Hoofnagle, Jr.

[57] ABSTRACT

An integral connector includes first and second electrical clips and a conductive stem extending from the clips. A pair of laterally spaced resilient fingers formed at one end of the stem cooperate with a central finger aligned with and opposite to a space between the pair of reslient fingers to form the first electrical clip. Another resilient finger extends laterally from an intermediate portion of the stem and cooperates with the underside of laterally extending portions of the pair of resilient fingers to form the second electrical clip. An interconnection can be established between two electrical devices by inserting the devices into the first and second electrical clips, respectively. The interconnected electrical devices can be coupled to external circuitry by connection to the opposite end of the conductive stem.

6 Claims, 5 Drawing Figures

DUAL CLIP CONNECTOR

BACKGROUND OF THE INVENTION

1. Field of the Invention

This invention relates to a dual clip connector and more particularly to an integrally formed dual clip connector for use in interconnecting distinct electrical devices and coupling the interconnected devices to an external circuit.

2. Discussion of the Prior Art

In providing electrical coupling for electrical circuits, it is often necessary to interconnect first and second electrical devices and to couple the interconnected devices to an external circuit. Heretofore, prior art arrangements generally have provided this type of electrical coupling by utilizing an integrally formed connector structure which includes first and second distinct and independent connector coupling members for electrically engaging and retaining the electrical devices therein and a common conductive member coupled to the connector coupling members. With this arrangement, the electrical devices inserted into each of the connector coupling members are interconnected through the common conductive member and the interconnected devices may further be connected to an external circuit through the common conductive member. Connector structures of this type are disclosed in U.S. Pat. No. 3,479,634 which issued to J. Pritulsky, U.S. Pat. No. 3,270,311 which issued to L. L. Deer et al. and U.S. Pat. No. 2,832,942 which issued to H. H. French.

The above-noted prior art connector structures are quite expensive because they are formed of the three distinct and independent structural members, i.e., the two connector coupling members and the common member.

Accordingly, the purpose of this invention is to provide a new and improved connector of structure that will provide the electrical coupling noted above in an expeditious manner.

SUMMARY OF THE INVENTION

An integrally formed electrical connector in accordance with certain principles of this invention for interconnecting first and second electrical devices and coupling the interconnected devices to an external circuit includes first means for electrically coupling the connector to the external circuit and second means for engaging and receiving the first electrical device to connect the device to the first means. A third means includes portions of the second means cooperating with other portions of the third means for engaging and receiving the second electrical device and for coupling the second electrical device to the first means and the second means. Thus, by use of the integrally formed connector, the first and second electrical devices can be interconnected and the interconnected electrical devices can be coupled to the external circuit.

DETAILED DESCRIPTION

Figure 1:
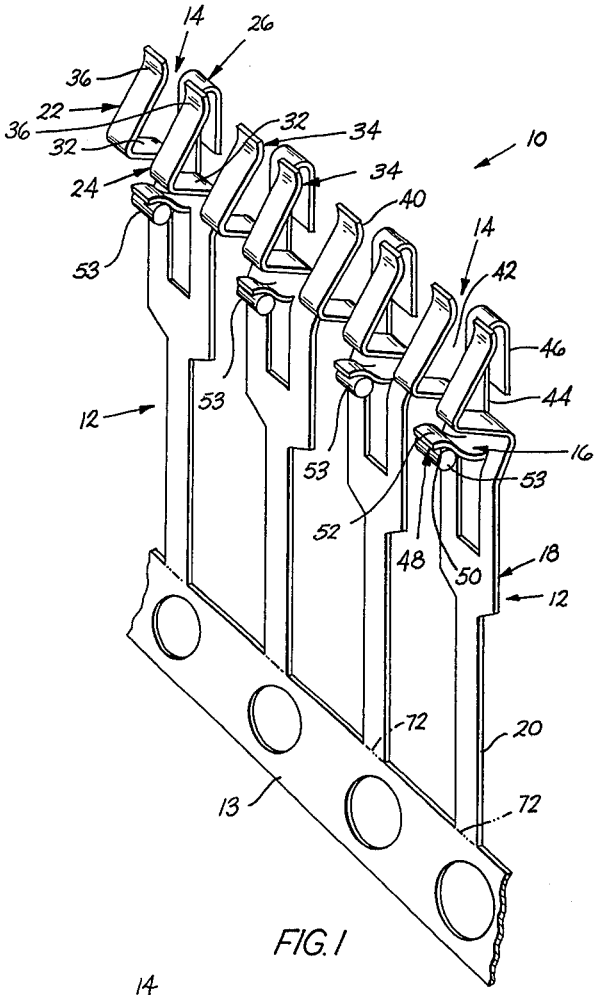
FIG. 1 is an isometric view illustrating portions of a plurality of connectors embodying principles of the invention.
Figure 2:
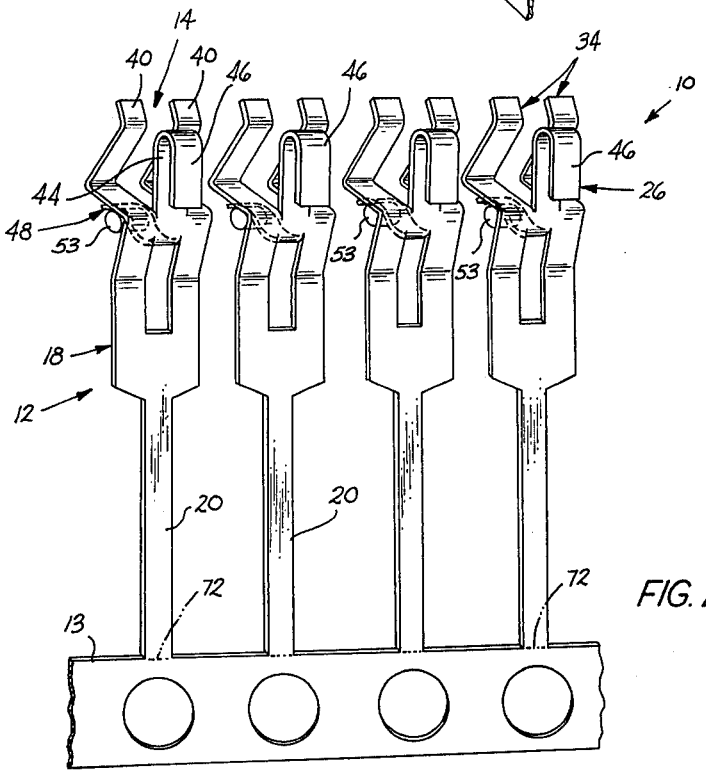
FIG. 2 is an isometric view illustrating other portions of the plurality of connectors illustrated in FIG. 1.

Referring to FIGS. 1 and 2, a terminal strip, generally designated by the numeral 10, is formed of a plurality of connectors, each generally designated by the numeral 12. The terminal strip 10 may be formed by stamping the plurality of connectors 12 from a conductive material, such as, for example, a copper nickel alloy. As illustrated, the plurality of connectors 12 are held together by a common strip 13 which is a portion of the material from which the connectors are formed.

Each connector 12 formed in the terminal strip 10 includes first and second electrical clips, generally designated by the numerals 14 and 16, respectively, an intermediate portion, generally designated by the numeral 18, and a stem portion 20. The connectors 12 can be used, for example, in attenuator structures of the type disclosed in the copending applications of J. G. Nance et al. entitled "Switchable Attenuator," Ser. No. 755,397 and T. W. Robbins et al. entitled "Switchable Attenuator and Method of Assembling Same," Ser. No. 755,396, which were both filed concurrently herewith and which are assigned to the same assignee.

The first electrical clip 14 of the connector 12 includes a pair of spaced resilient side fingers, generally designated by the numerals 22 and 24, respectively, and a central resilient finger generally designated by the numeral 26. The resilient fingers 24 each include a portion 32 which extends laterally from the intermediate portion 18 at an upper end thereof. Another portion of the fingers 22 and 24, each generally designated by the numerals 34, extends upwardly from the portion 32 with the upper end of the portion 34 angled toward the plane of the intermediate portion 18. Contoured ends 36 are formed in the upwardly extending portions 34 to provide contact surfaces 40 (FIG. 2) which are for engaging conductive portions of an electrical device, such as, for example, a thin film circuit substrate 56 (FIGS. 3 and 4) to be supported in the first electrical clip 14. The electrical coupling capability of the contact surfaces 40 can be enhanced by adding additional conductive material thereon, such as, for example, gold.

The central resilient finger 26 of the first electrical clip 14 extends from the upper end of the intermediate portion 18 in the plane thereof and is generally opposed to and aligned with a space 42 between the resilient fingers 22 and 24. The central finger 26 of each connector 12 is formed in an inverted U-configuration including a portion 44 which terminates in a retaining hook 46. The portion 44 of the central finger 26 cooperates with the upwardly extending portions 34 of the resilient fingers 22 and 24 to provide clamping action sufficient to support and retain an electrical device, such as, for example, the thin film circuit substrate 56 (FIGS. 3 and 4) therebetween. The portion 44 may also be formed with a contact surface (not shown) to electrically engage conductive members on a circuit device, such as, for example, when it is desired to establish electrical connection on a thin film circuit substrate (not shown) having circuits on both sides thereof. The retaining hook 46 of the central finger 26 is provided to facilitate mounting of the connector 12, such as, for example, when the connector is used in an attenuator structure as disclosed in the aforementioned copending applications of J. G. Nance et al. and T. W. Robbins et al.

A resilient finger, generally designated by the numeral 48 (FIG. 1) is formed on and extends laterally from the intermediate portion 18 of each of the connectors 12. The finger 48 is aligned with the space 42 to cooperate with the underside of the laterally extending portions 32 of the resilient fingers 22 and 24 to form the second electrical clip 16. The laterally extending finger 48 has a contoured end 50 formed therein to provide a contact surface 52 for electrically engaging a conductive member of an electrical circuit device, such as, for example, a thin film circuit substrate 54 (FIGS. 3 and 4) to be inserted into the second electrical clip 16. The contact surface 52 may also be coated with an additional conductive material, such as, for example, gold to enhance electrical coupling.

Ordinarily, additional conductive material is provided in the form of a coating when electrical coupling will be of a frequent but temporary nature, such as, for example, in a switching operation. When the electrical coupling is to be of a permanent nature, solder may be provided, such as, for example, in the form of a solder slug 53 which can be preassembled with the fingers 48 in the contoured ends 50 of the fingers; or can be predeposited on the contact surface 52. Similarly, solder may also be provided for other contact surfaces included in the connector 12.

Figure 3:
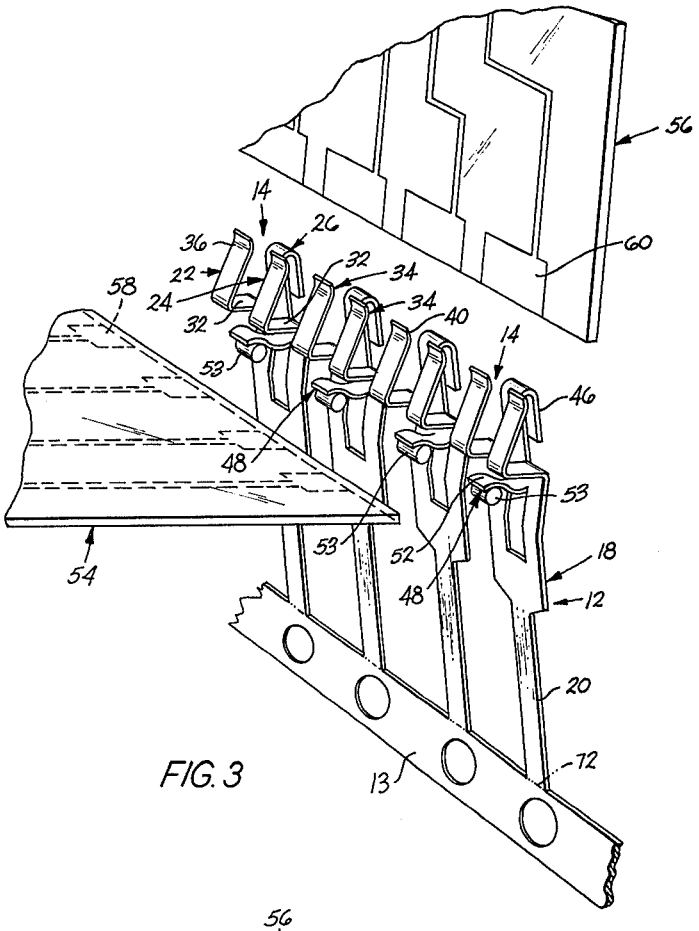
FIG. 3 is an isometric view illustrating the plurality of connectors aligned with a pair of electrical devices.
Figure 4:
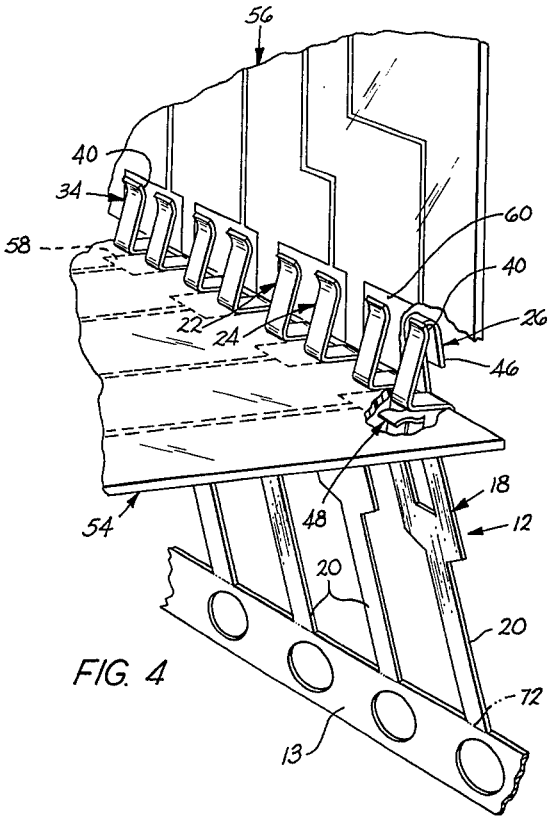
FIG. 4 is an isometric view illustrating the plurality of connectors in FIG. 3 after having been electrically coupled to the electrical circuit devices.

As is illustrated in FIGS. 3 and 4, a plurality of connectors 12 can be used to interconnect a plurality of electrical devices, such as, for example, printed circuit or thin film circuit substrates 54 and 56 having conductive pads 58 and 60, respectively, which provide electrical paths to circuitry (not shown) on the substrates. The contact surfaces 40 on the portions 34 of the electrical clips 14 will electrically engage the conductive pads 60 of the thin film circuit substrate 56 upon insertion of the circuit substrate in the electrical clips (FIG. 4). Similarly, the contact surfaces 52 on the laterally extending fingers 48 of the electrical clips 16 will electrically engage the conductive pads 58 of the thin film circuit substrate 54 upon insertion of the circuit substrate into the clips (FIG. 4). As a result, the electrical clips 14 and 16 of the connectors 12 will electrically couple the circuits (not shown) on the circuit substrates 54 and 56 to the connectors and through the connectors to each other.

Once the circuit substrates 54 and 56 have been interconnected, permanent electrical connections can be established between the contact surfaces 52 of the connectors 12 and the conductive pads 58 of the circuit substrate 54 by applying molten solder onto the area whereat the contact surfaces 52 engage the pads or by melting the solder slug 53. The connectors 10 can then be separated by breaking away the common strip 13 at perforations 72. Once the connectors 12 are separated, the stem portion 20 of the connectors can then be coupled to an external circuit (not shown) such as, for example, a printed circuit board, to establish an electrical connection between the interconnected circuit substrates 54 and 56 and the external circuit through the stem portion.

Figure 5:
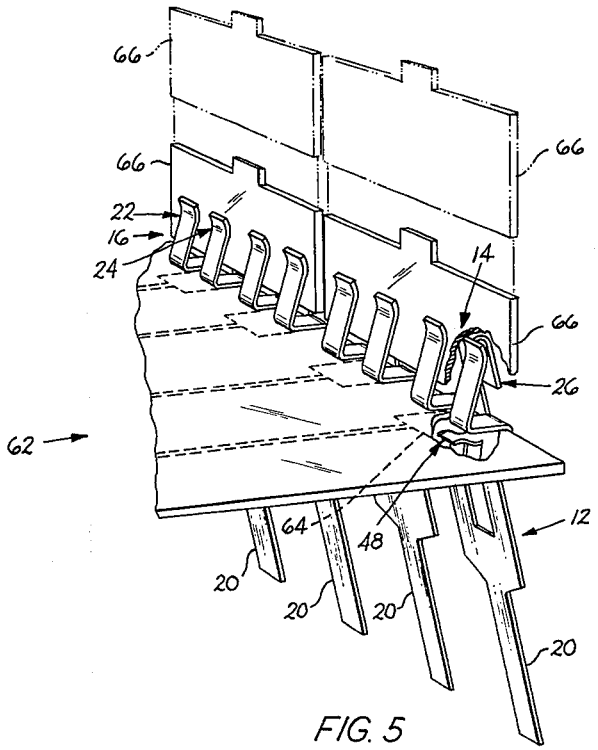
FIG. 5 is an isometric view illustrating a plurality of connectors being utilized to implement a switching arrangement.

In another utilization, the connectors 12 can be used in implementing a switching function, such as, for example, as is illustrated in FIG. 5. In this utilization, a circuit substrate, generally designated by the numeral 62, is provided which is electrically coupled via conductive pads 64 to the electrical clips 16 of the connectors 12. The conductive pads 64 are connected to circuits (not shown) on the circuit substrate 62. Conductive shorting blades 66 can then be inserted selectively into respective adjacent ones of the clips 14 of the connectors 12 to complete a circuit path between selected adjacent ones of the conductive pads 64 and thereby couple the circuits associated therewith. Similarly, upon removal of the shorting blades 66 from the clips 14, as illustrated in phantom, the circuit paths between selected adjacent ones of the conductive pads 64 are opened thereby breaking the connections between the circuits associated with the respective conductive pads.

Thus, the connector 12 embodying the principles of this invention includes the first and second clips 14 and 16 each for receiving and providing electrical coupling to a separate electrical device. Additionally, the intermediate portion 18 and the electrical stem 20 are formed integrally with the first and second clips 14 and 16, respectively, to electrically interconnect the first and second clips and to provide electrical coupling to external circuitry. Further, in accomplishing an economical and efficient interconnecting of circuits by use of the connector 12, the finger 48 of the second clip 16 cooperates with the undersides of the portions 32 of the fingers 22 and 24 to form the second clip while the fingers 22 and 24 also form a portion of the first clip 14. This cooperation reduces space requirements within the connector 12 for the two clips 14 and 16 and reduces the number of costly forming operations required in manufacturing the connector.

It is to be understood that the above-described embodiments are simply illustrative of this invention. Other embodiments may be devised by those skilled in the art which will embody the principles of the invention and fall within the spirit and scope thereof.

What is claimed is:

1. An electrical connector for interconnecting first and second electrical devices and coupling the interconnected devices to external circuitry comprising:

means for electrically coupling the connector to the external circuitry;

at least two resilient fingers in generally opposed spaced relationship for engaging and receiving the first electrical device therebetween; and a projecting finger formed in an intermediate portion of the connector and extending in a given direction therefrom in generally opposed spaced relationship to a portion of one of the resilient fingers extending in the given direction from the intermediate portion of the connector, for engaging and receiving the second electrical device therebetween.

2. An electrical connector as defined in claim 1 wherein the electrically coupling means includes an electrical stem coupled at one end to the intermediate portion of the connector and having another end which can be coupled to the external circuitry.

3. An electrical connector as defined in claim 1 wherein a second of the resilient fingers is of a generally U-shaped configuration to form a retaining hook for facilitating the mounting of the connector into an independent associated device.

4. An electrical connector as defined in claim 1 wherein:

the one resilient finger includes a second portion projecting from the portion of the finger which extends from the intermediate portion of the connector in the given direction; and a second of the resilient fingers extends from the intermediate portion of the connector in generally opposed spaced relationship to the second portion of the one finger and cooperates with the second portion to engage and receive the first electrical device therebetween.

5. An electrical connector for interconnecting first and second electrical devices and coupling the interconnected electrical devices to external circuitry comprising:

an electrical stem for coupling the connector to the external circuitry;

a first electrical clip including a pair of spaced resilient fingers and a central finger in generally opposed spaced relationship to the pair of resilient fingers and with a space between the pair of resilient fingers, for engaging and receiving the first electrical device and for coupling the first electrical device to the electrical stem; and a second electrical clip including a projecting finger formed in an intermediate portion of the connector and including portions of the pair of resilient fingers which are spaced from the projecting finger for engaging and receiving the second electrical device and for coupling the second electrical device to the electrical stem.

6. An integral electrical connector for interconnecting first and second electrical devices and coupling the interconnected electrical devices to external circuitry comprising:

an electrical stem for coupling the connector to the external circuitry;

a first electrical clip including first and second spaced resilient fingers and a central finger in generally opposed spaced relationship to the resilient fingers and aligned with a space between the first and second resilient fingers, the first and second resilient fingers each including first and second portions, the second portion of each resilient finger being coupled to and supporting the first portion of the resilient finger and the first portion being spaced from and cooperating with the central finger to engage and receive the first electrical device therebetween and to couple the first electrical device to the electrical stem; and a second clip including a projecting finger formed in an intermediate portion of the connector and including portions of the second portions of the first electrical clip, the second portions of the first electrical clip being spaced from and cooperating with the projecting finger to engage and receive the second electrical device therebetween and to couple the second electrical device to the electrical stem and the first electrical device.

* * * * *